US006546962B1

(12) United States Patent
Sunde

(10) Patent No.: US 6,546,962 B1
(45) Date of Patent: Apr. 15, 2003

(54) INTRODUCTION OF AIR INTO INJECTION WATER

(75) Inventor: Egil Sunde, Sandnes (NO)

(73) Assignee: Den norske Stats oljeselskap A.S., Stavanger (NO)

( * ) Notice: Subject to any disclaimer, the term of this patent is extended or adjusted under 35 U.S.C. 154(b) by 0 days.

(21) Appl. No.: 09/582,929

(22) PCT Filed: Jan. 7, 1999

(86) PCT No.: PCT/GB99/00045

§ 371 (c)(1),
(2), (4) Date: Jul. 7, 2000

(87) PCT Pub. No.: WO99/35369

PCT Pub. Date: Jul. 15, 1999

(30) Foreign Application Priority Data

Jan. 9, 1998 (GB) ..... 9800478

(51) Int. Cl.[7] ..... E21B 43/22
(52) U.S. Cl. ..... 137/893; 166/246; 261/76
(58) Field of Search ..... 261/DIG. 75, 76; 166/268, 246; 210/198.1; 137/888, 893

(56) References Cited

U.S. PATENT DOCUMENTS 3,766,020 A * 10/1973 Sieder ..... 203/26
4,037,024 A * 7/1977 Landau ..... 429/17
4,222,825 A * 9/1980 Eisden ..... 203/11
4,286,660 A * 9/1981 Wagner et al. ..... 166/246
4,315,545 A * 2/1982 Blair, Jr. ..... 166/274
4,695,378 A 9/1987 Ackman
4,885,084 A 12/1989 Doyle
5,163,510 A 11/1992 Sunde
5,421,408 A 6/1995 Stoisits
5,511,907 A * 4/1996 Tabasco ..... 166/246
5,560,737 A * 10/1996 Schuring et al. ..... 166/246
5,858,766 A * 1/1999 Premuzic et al. ..... 435/262.5
6,054,102 A * 4/2000 Tanimura et al. ..... 422/186.15

OTHER PUBLICATIONS

Sunde et al., "Aerobic Microbial Enhanced Oil Recovery for Offshore Use", SPE/DOE #24204, Apr. 22, 1992, pp. 497–502.

Andersen, "Field Tests of the Water/Liquid Oxygen Injection Process", SPE #30994, Sep. 17, 1995, pp. 123–135.

Byars, et al, "Injection Water+Oxygen=Corrosion and/or Well Plugging Solids", SPE #4253, Dec. 4, 1972, pp. 95–104.

* cited by examiner

*Primary Examiner*—John Rivell
(74) *Attorney, Agent, or Firm*—Patterson, Thuente, Skaar & Christensen, P.A.

(57) ABSTRACT

Air is introduced into the injection water for microbial enhanced oil recovery. The injection water is passed through an ejector where it is entrained and the oxygen subsequently dissolves in the water.

21 Claims, 2 Drawing Sheets

INTRODUCTION OF AIR INTO INJECTION WATER

Figure 1:
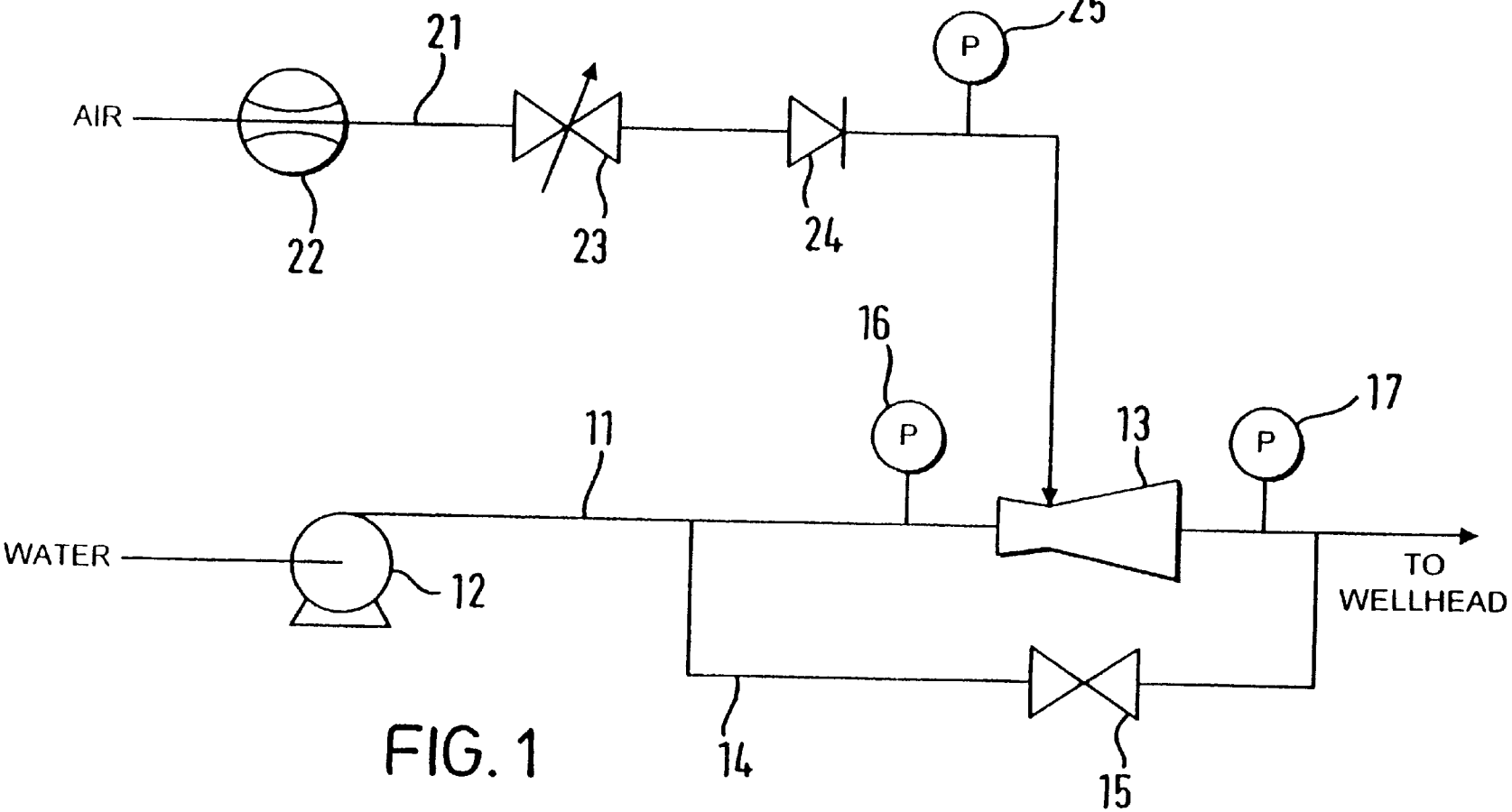

The present invention relates to the introduction of air into water, particularly injection water used in oil recovery.

When oil is present in subterranean rock formations such as sandstone or chalk, it can generally be exploited by drilling into the oil-bearing measures and allowing existing overpressures to force the oil up the borehole. This is known as primary removal. When the overpressure approaches depletion, it is customary to create an overpressure, for example by injecting water into the formations to flush out standing oil. This is known as secondary removal.

However, even after secondary removal, a great deal of oil remains in the formations; in the case of North Sea oil, this may represent 65% to 75% of the original oil present. Of this remaining oil probably more than half will be in the form of droplets and channels adhering to the rock formations that have been water-flooded and the remainder will be in pockets which are cut off from the outlets from the field.

Several enhanced oil recovery methods have been proposed to exploit the accessible but adhering oil remaining in the rock formations, one of which is microbial enhanced oil recovery (MEOR). This entails the use of micro-organisms such as bacteria to dislodge the oil, and a number of systems have been proposed. In the case of consolidated measures, one such system employs aerobic bacteria.

The absence of any oxygen in oil bearing formations means that if an aerobic system is to be used, then oxygen must be supplied. However, when aerobic bacteria are used and oxygen (or air, containing oxygen) is injected into the formation, the situation may not be satisfactory. Firstly, there is an immediate separation into a gaseous and an aqueous phase, which makes control of the system very difficult and in practice, limits the system to batch-type operation. Secondly, a great deal of heat is generated, which, in view of the oxygen-rich gaseous phase and the readily available combustible material, presents a considerable risk of explosion. A cooling medium must therefore also be employed.

The solution to this problem is addressed in British Patent No. 2252342. In this case, the injection water used contains a source of oxygen capable of yielding at least 5 mg/l free oxygen.

Essentially, the system is operated as follows. A population of aerobic bacteria is introduced into the formation at a position spaced from a production borehole. The micro-organisms are adapted to use oil as a carbon source. Pressurised injection water is introduced into the formation via an injection borehole, the water including a source of oxygen and mineral nutrients. The bacteria multiply using the oil as their main carbon source and the oxygen in the injection water as their main oxygen source. In so doing, they dissociate the oil from the rock formation and the dissociated oil is removed via the production borehole by the injection water.

The rate of growth of micro-organisms is of course dependent on the available oxygen. In general maximum growth is desired and therefore it is desirable to maintain a high oxygen concentration in the injection water (and clearly also in advancing biomass layer). In some situations however, for instance where it may be desirable to stimulate the production of surfactants, the level of oxygen in the water phase might need to be reduced in order to stress the micro-organisms into producing surfactants.

A situation would normally be established in which the biomass layer forms a front between the oxygen-rich injection water and oxygen-depleted water on the outlet side of the front. Initially, the oxygen-depleted water will be the formation water or oxygen free injection water but as the process progresses, it will be displaced by injection water, stripped of its oxygen as it passes through the biomass layer. Where the biomass is in contact with oil and has access to oxygen, it will feed on the oil, thereby dissociating the oil from the rock by one or more of a number of mechanisms. The principal mechanism is believed to be the production of surfactants which reduce the forces attaching the oil to the rock. The pressure of the injection water then forces the oil out of the rock pores and the oil is carried forwards by the injection water.

Normally, sea water for example would be expected to carry about 6 mg/l of oxygen in solution. In order to provide the bacteria with its required oxygen source, a significant amount of oxygen must therefore be introduced into the injection water. One way of achieving this would be with the use of an air compressor. However, where the back pressures (well head pressures) are high, for example, above 8 atm (810 KPa), the compressor required would be very costly. Furthermore, compressors require servicing and are prone to failure, particularly when operating at high pressures in demanding conditions.

It is therefore an object of the present invention to provide a system for introducing oxygen into water, particularly injection water for oil recovery, in an inexpensive and reliable fashion.

It is a further object to enable the introduction to be achieved over a very large range of water back pressures.

According to the invention, there is provided the use of an ejector for introducing oxygen into injection water for oil recovery in which the injection water is supplied to the ejector at a predetermined pressure and oxygen, optionally as air, is also supplied to the ejector, the pressure and velocity of the water passing through the ejector being arranged to draw oxygen into the water stream. The amount of oxygen drawn into the water is preferably capable of being dissolved entirely at the wellhead (or formation) pressure as well as being sufficient to achieve the desired effect in the formation.

The ejector uses the energy of the injector pump to accelerate the injection water, thereby reducing the pressure in order to draw in the air and requires a minimum of maintenance. It is very inexpensive compared to a compressor, particularly in high wellhead pressure applications. In addition, the use of an ejector enables very stable oxygen/water ratios to be achieved.

In marine situations, the injection water would be sea water. Preferably, the injection water is supplied at the predetermined pressure by means of an injection pump. Preferably, the ejector is located in the injection water line between the injection pump and the well head. Alternatively, the ejector can be located at the water suction side of the pump, particularly when the amount of oxygen to be introduced is small, for example, less than 50 mg oxygen per litre of water.

The pump pressure may vary enormously in dependence upon the well head pressure. Thus, the pump pressure may range from 2 to 700 bar (0.2 to 70 MPa). The injection pressure may vary from 0.9 to 350 bar (0.09 to 35 MPa). The air:water ratio can also be varied considerably, depending upon various factors, including the requirement of the micro-organism and the wellhead pressure, and a range of from 0.03:1 to 6:1 expressed in litres of air at normal conditions to litres of water.

The invention also extends to a method for introducing oxygen into injection water for oil recovery which comprises: supplying water to an ejector by means of an injection pump; supplying oxygen, optionally as air, to the ejector; drawing oxygen into the water in the ejector. The oxygen may then dissolve in the water downstream of the position where the air is introduced.

The invention also extends to apparatus for carrying out this method, which comprises an injector pump, a source of water, a source of oxygen and an ejector, and in which the source of water is connected to the injector pump which supplies the water to the ejector and the source of oxygen is also connected to the ejector; whereby the water passing through the ejector draws oxygen into the water.

Preferably, the injector pump is a high pressure pump. Preferably, the apparatus includes a water line bypassing the ejector, the bypass line including a bypass valve. Preferably, the source of oxygen is an air line, the air line including a control valve and optionally a check valve. Preferably, the ejector is fitted with a check valve that closes at internal pressures greater than a given value, for example 0.9 bar (0.09 MPa). Preferably, the ejector is equipped with a passive or active air flow control and measuring system.

Naturally, the ejector will be designed for the specific operating conditions of each well/field, with regard to water volume, air concentration and injection pressure.

Since the pressures involved with the injection water may be very high, the amount of gaseous oxygen that can be dissolved may be quite considerable. The pressures encountered in some high pressure oil-bearing formations may be from 200 to 800 bar (20–80 MPa); at these pressures up to 4.0 g of oxygen may be dissolved in a litre of water. This quantity is amply sufficient to allow aerobic bacteria to multiply at a satisfactory rate with a bulk flow rate of the injection water which is low enough to avoid reservoir damage.

Preferably, therefore, the amount of oxygen dissolved will be from 1 mg/l to 4000 mg/l more preferably from 10 mg/l to 400 mg/l though the actual amount will be dependent upon the prevailing conditions. The amount of oxygen present should not be as much as would be toxic to the bacteria.

In practice, the avoidance of a gas phase is very important since microbial activity can only proceed in the liquid phase. Clearly, if a gas phase is present, the oil adhering to the rock formation within the gas phase will remain unaffected by the micro-organisms.

The micro-organisms may be any convenient single-cell organisms such as yeasts but are most preferably bacteria. Suitable bacteria may be *Pseudomonas putida, Pseudomonas aeruginosa, Corynebacterium lepus, Mycobacterium rhodochrous, Mycobacterium vaccae,* Acinetobacter and Nocardia. The bacteria used may be pre-selected and cultivated to thrive in the injection water under the prevailing conditions.

Figure 2:
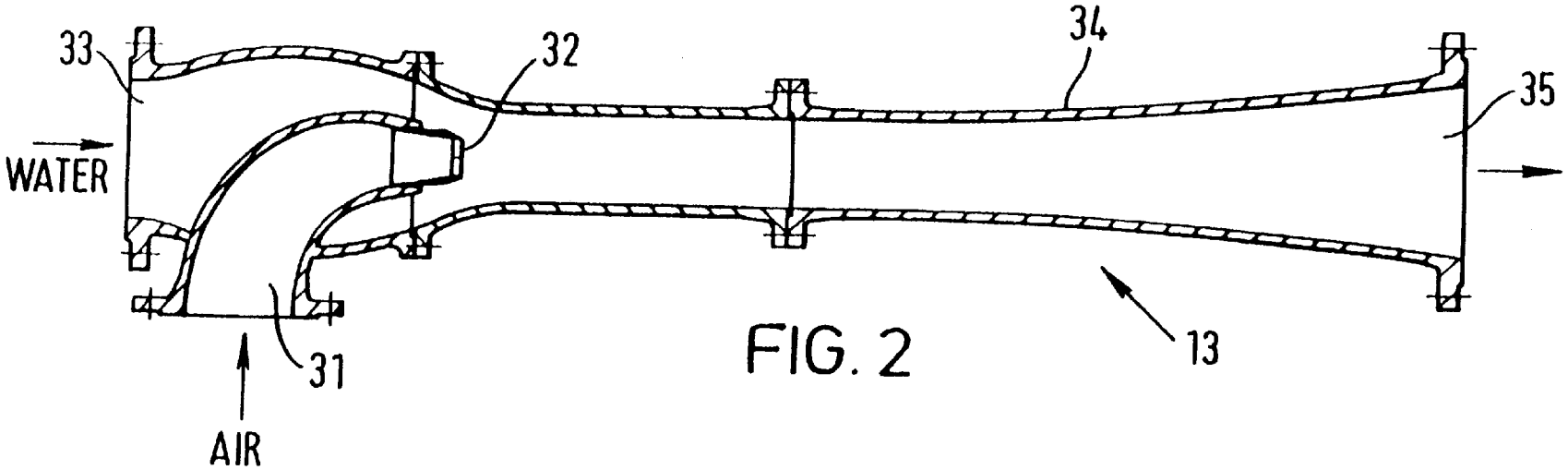

The invention may be carried into practice in various ways and some embodiments will now be described by way of example with reference to the accompanying drawings, in which:

FIG. 1 is a schematic diagram showing a water injection system for an oil well incorporating the introduction of air in accordance with the invention; and FIG. 2 is a schematic (section?) through a suitable ejector.

FIG. 1 shows an injection water line 11 directed to a wellhead (not shown). The water is supplied by means of an injection pump 12. An ejector 13 is located between the pump 12 and the wellhead. A bypass line 14 including a valve 15 bypasses the ejector and pressure gauges 16,17 are located on the water line 11 on either side of the ejector respectively downstream of the bypass line inlet and upstream of the bypass line return.

An air line 21 is connected to the ejector 13. The air line 21 includes a flow meter 22, a control valve 23, a check valve 24 and a pressure gauge 25.

The ejector 13 is in the form of a jet pump. It comprises a first fluid inlet 31 for the air leading to a nozzle 32, and a second fluid inlet 33 for the water. The air and water mix in the vicinity of the nozzle 32. Downstream of the nozzle 32, the ejector includes a venturi 34 leading to an outlet 35.

In operation, the pump 12 operates at a constant speed, pumping water to the wellhead, via the ejector 13. Air is drawn into the water stream at the ejector 13 and dissolves in the water, by virtue of the high water pressure, between the ejector 13 and the wellhead. The amount of air supplied is adjusted using the control valve 23 and this is controlled in dependence upon the pressure in the air line 21 measured by the pressure gauge 25 and the pressure drop across the ejector 13 measured by the pressure gauges 16,17. The amount of air drawn into the water is also affected by the proportion of water which passes via the bypass line 14, thus avoiding the ejector 13.

En an alternative embodiment, for example, when the amount of oxygen to be introduced into the water is small, typically less than 50 mg/l, the injector 13 may be located on the suction side of the pump 12, together with its bypass line 14 and valve 15.

The invention will be further illustrated in the following Example.

In one typical on-shore injection well, with a high wellhead pressure of about 68 bar (6.8 MPa), an injection pump is used which operates at 188 bar (18.8 MPa). The pump supplies water at a rate of 40 l/min. To achieve an air:water ratio of 1:1, an ejector 13 with a throat diameter of 2 mm is used, resulting in a water linear velocity of about 118 m/s.

What is claimed is:

1. The use of an ejector for introducing oxygen into injection water for oil recovery, in which:

injection water is supplied to said ejector at a predetermined pressure and passes through said ejector as a stream;

oxygen is also supplied to said ejector at an adjustably controlled rate; and the pressure and velocity of said water stream passing through said ejector are arranged to draw said oxygen into said water stream, wherein said controlled rate of oxygen supply is controlled based on feedback as to the pressure within the oxygen supply line and the pressure differential across the ejector so as to result in a predetermined stable concentration of dissolved oxygen in said injection water.

2. A use according to claim 1, in which said water is sea water.

3. A use according to claim 2, in which said injection water is supplied at said predetermined pressure by means of an injection pump.

4. A use according to claim 3, in which said ejector is located in an injection water line between said injection pump and a well head.

5. A use according to claim 4, in which said ejector is on the suction side of the injection pump.

6. A use according to claim 3, in which the pressure of said injection pump is about 2 to about 700 bar (0.2 to 70 Mpa).

7. A use according to claim 3, in which the injection pressure is about 0.9 to about 350 bar (0.09 to 35 Mpa).

8. A use according to claim 1, in which said oxygen is supplied as air.

9. A use according to claim 8, in which the air:water ratio after injection is about 0.03:1 to about 6:1 expressed in liters of air at normal conditions to liters of water.

10. A method for introducing oxygen into injection water for oil recovery which comprises:

supplying water to an ejector by means of an injection pump;

supplying oxygen to the ejector at an adjustably controlled rate; and drawing said oxygen into the water in the ejector, wherein said controlled rate of oxygen supply is controlled based on feedback as the pressure within the oxygen supply line and the pressure differential across the ejector so as to result in a predetermined concentration of dissolved oxygen in said injection water.

11. A method according to claim 10, in which said oxygen is supplied as air.

12. A method according to claim 10, in which said water is sea water.

13. A method according to claim 10, in which the pressure of said injector pump is about 2 to about 700 bar (0.2 to 70 MPa).

14. A method according to claim 10, in which the injection pressure is about 0.9 to about 350 bar (0.09 to 35 MPa).

15. A method according to claim 10, in which the air:water ratio after injection is about 0.03:1 to about 6:1 expressed in liters of air at normal conditions to liters of water.

16. Apparatus for carrying out a method according to claim 10, which comprises: an injector pump, a source of water, means for supplying oxygen at an adjustably controlled rate, and an ejector, and in which said source of water is connected to said injector pump, said injector pump supplies said water to said ejector, and said means for supplying oxygen is also connected to said ejector; whereby said water passing through said ejector draws oxygen into said water, and whereby said means for supplying oxygen may be adjusted so that said water has a predetermined concentration of dissolved oxygen.

17. Apparatus according to claim 16, in which said injector pump is a high pressure pump.

18. Apparatus according to claim 16, further comprising a bypass water line bypassing said ejector, said bypass water line including a bypass valve.

19. Apparatus according to claim 16, in which said means for supplying oxygen is an air line, said air line including a control valve.

20. Apparatus according to claim 19, in which said air line further includes a check valve.

21. Apparatus according to claim 16, in which said ejector is fitted with a check valve that closes at internal pressures greater than about 0.9 bar (0.09 MPa).

* * * * *